US005940579A

United States Patent [19]

Källgren et al.

[11] Patent Number: 5,940,579

[45] **Date of Patent: *Aug. 17, 1999**

[54] CAPACITIVE LEAKAGE CURRENT CANCELLATION FOR HEATING PANEL

[75] Inventors: Johan Källgren, Columbus; Donald A. Coates, Worthington; Sanjay Shukla, Hilliard; Steven M. Dishop, Bellefontaine, all of Ohio

[73] Assignee: White Consolidated Industries, Inc., Cleveland, Ohio

[ * ] Notice: This patent is subject to a terminal disclaimer.

[21] Appl. No.: 08/805,621

[22] Filed: Feb. 26, 1997

[51] Int. Cl.[6] ..... F24D 19/02; H05B 3/00

[52] U.S. Cl. ..... 392/433; 219/509; 219/543; 219/544; 219/395; 338/295; 338/325; 338/308; 338/309

[58] Field of Search ..... 392/432–439; 219/509, 543, 544, 395, 464, 448, 443, 445, 446; 338/325, 308, 309, 295; 361/42, 47, 48

[56] References Cited

U.S. PATENT DOCUMENTS

| | | | |
|---|---|---|---|
| Re. 33,529 | 1/1991 | Cremer et al. | 219/543 |
| 2,475,379 | 7/1949 | Stong | 338/309 |
| 2,678,990 | 5/1954 | Quirk . | |
| 2,803,566 | 8/1957 | Smith-Johannsen | 219/543 |
| 3,063,881 | 11/1962 | Harwig | 219/543 |
| 3,177,345 | 4/1965 | Plumat | 392/435 |
| 3,385,959 | 5/1968 | Ames et al. | 219/543 |
| 3,412,234 | 11/1968 | Otavka . | |
| 3,465,121 | 9/1969 | Clark . | |
| 3,465,125 | 9/1969 | McArthur, Jr. . | |
| 3,752,348 | 8/1973 | Dickason et al. | 219/203 |
| 3,800,121 | 3/1974 | Dean et al. . | |
| 3,848,111 | 11/1974 | Brouneus | 219/543 |
| 3,879,652 | 4/1975 | Billings . | |
| 3,895,213 | 7/1975 | Levin | 219/203 |
| 3,958,172 | 5/1976 | Beck . | |
| 4,055,745 | 10/1977 | Balaguer . | |
| 4,100,435 | 7/1978 | Komuro . | |
| 4,136,733 | 1/1979 | Asselman et al. . | |
| 4,163,139 | 7/1979 | Malarkey et al. . | |
| 4,167,696 | 9/1979 | Gyursanszky . | |
| 4,219,857 | 8/1980 | Haraldsson et al. . | |
| 4,298,789 | 11/1981 | Eichelberger et al. . | |
| 4,370,692 | 1/1983 | Wellman, Jr. et al. . | |
| 4,424,439 | 1/1984 | Payne et al. . | |
| 4,459,470 | 7/1984 | Shlichta et al. | 219/522 |
| 4,591,701 | 5/1986 | Tokumaru | 219/543 |

(List continued on next page.)

FOREIGN PATENT DOCUMENTS

| | | |
|---|---|---|
| 2138868 | 6/1996 | Canada . |
| 3735265 | 4/1989 | Germany . |
| 4224666 | 1/1994 | Germany . |
| 8-17560 | 1/1996 | Japan . |
| 2272619 | 5/1994 | United Kingdom . |
| 8905561 | 6/1989 | WIPO . |

*Primary Examiner*—Teresa Walberg
*Assistant Examiner*—Vinod D. Patel
*Attorney, Agent, or Firm*—Pearne, Gordon, McCoy & Granger LLP

[57] ABSTRACT

A heating panel has a resistive heating layer formed on a substrate. Insulating layers can be formed on the substrate. The heating layer has electrodes on opposite edges connected to different phases of a multiphase power source. Capacitive currents caused in the substrate by the different phases cancel each other. Thus, leakage current is minimized through a conductor connected between the substrate and ground. The heating panel can be adapted for two phase or three phase systems. The heating panels are particularly useful for defining a heating cavity of an oven or pots on a cook top.

42 Claims, 6 Drawing Sheets

U.S. PATENT DOCUMENTS 4,616,125 10/1986 Oppitz .
4,618,817 10/1986 Holtslander .
4,816,647 3/1989 Payne .
4,878,011 10/1989 Holtslander .
4,885,456 12/1989 Tanaka et al. .
4,889,974 12/1989 Auding et al. ..... 219/543
4,897,527 1/1990 Cripps et al. .
4,900,900 2/1990 Shirae et al. .
4,918,288 4/1990 Carter et al. ..... 219/203
5,051,603 9/1991 Walker .
5,079,409 1/1992 Takada et al. .
5,088,389 2/1992 Labadia del Fresno .
5,164,161 11/1992 Feathers et al. .
5,182,464 1/1993 Woodworth et al. .
5,216,303 6/1993 Lu .
5,221,829 6/1993 Yahav et al. .
5,235,159 8/1993 Kornrumpf et al. .
5,245,219 9/1993 Romatzick, Jr. et al. .
5,293,028 3/1994 Payne .
5,304,784 4/1994 Tagashira et al. .
5,347,106 9/1994 Reiser et al. ..... 219/543
5,367,369 11/1994 Nakai et al. .
5,410,193 4/1995 Backus et al. .
5,438,914 8/1995 Höhn et al. .
5,440,667 8/1995 Simpson et al. .
5,577,158 11/1996 Kallgren et al. ..... 219/543

CAPACITIVE LEAKAGE CURRENT CANCELLATION FOR HEATING PANEL

BACKGROUND OF THE INVENTION

This invention relates generally to the field of heating and specifically to minimizing leakage currents in a heating panel.

Ovens and pots or pans on cook tops are commonly heated by one or more of several means, including burning combustible gases and electrical resistance. One form of electrical resistance heating uses monolithic integrated heat sources, known as "heat panels," disposed on walls of the oven or cook top. Heat panels include a thermally and electrically conductive metal substrate or core covered by a thermally conductive and electrically insulative material on opposed faces. One face of the insulative material has a heating layer or film of electrically resistive material disposed thereon and connected to a current to generate heat. The heat is conducted through the other layers to the oven cavity. Examples of such apparatus are shown in U.S. Pat. Nos. 4,298,789 to Eichelberger, and 5,577,158 to Källgren and application Ser. No. 08/503,039 filed Jul. 17, 1995 by K ällgren, et al incorporated herein by reference.

Industry standards require the substrate to be connected to ground. Electrically conductive layers separated by an insulating layer form a capacitor. Thus, when an alternating current (AC) passes through the heating layer, capacitive coupling causes an AC leakage current in the substrate or other conductor. This capacitive current and a resistive leakage current through the insulator become leakage current to ground when the substrate is connected to ground. The leakage current to ground can exceed industry standards or codes. Thus, the need exists for a heating panel type oven or cook top that will meet industry standards.

In addition, if the substrate is connected to neutral or ground of a power source, the leakage current should also be minimized. If the substrate is floating, the electrical potential that builds up thereon must be minimized.

BRIEF SUMMARY OF THE INVENTION

The present invention provides a heating panel including a heating layer of electrically resistive sheet material disposed on a substrate, the substrate can be an insulator, such as glass ceramic or an electrically conductive sheet material such as steel or aluminum. An insulating layer can be disposed between the heating layer and the substrate. First and second electrodes are attached to the heating layer and adapted for being electrically connected to different phases of a multiphase power source such as a synthetic 240 V household power source, commonly known as the Edison System. The heating layer is adapted for converting electrical current therethrough to heat energy transferred therefrom. The substrate is adapted for being connected to ground.

The insulating layer can conduct heat from the resistive sheet to the space or object being heated. A second insulating layer can be disposed on a face of the substrate opposite the first insulating layer. The first and second insulating layers can be joined so as to substantially enclose the substrate. The first and second electrodes are disposed along opposite edges of the heating layer, and the third electrode is disposed between the first and second on a face of the heating layer. The electrodes are elongated bars having substantially identical lengths. The heating layer is typically graphite, tin dioxide, or resistive thick film and the insulating layer is made of ceramic or organic polymers.

If the power source has two phases, the first and second electrodes are adapted for being connected 180° out of phase. Another electrode can be electrically connected to the heating layer and connected to a third phase of the power source. A fourth electrode is connected to the first phase. If the power source has three phases, the first, second, and third electrodes are adapted for being connected 12020 out of phase from each other. The first and fourth electrodes are disposed along opposite edges of the heating layer and the second and third electrodes are evenly spaced between the first and fourth electrodes.

The invention also provides a heating panel assembly including first and second heating panels. The first electrodes are respectively adapted for being electrically connected to different phases of a multiphase power source, and the second electrodes are adapted for being electrically connected to a neutral of the power source or to each other. The heating panels are arranged to define a heating cavity. A third heating panel has a first electrode adapted for being electrically connected to a phase of the multiphase power source different from the phases to which the first electrodes of the first and second panels are adapted for being connected. The second electrode of the third panel being adapted for being electrically connected to the neutral of the power source or to each other or to another phase of the multiphase power source.

In another construction of the heating panel, first and second heating layers of electrically resistive sheet material are disposed on one substrate. First and second electrodes are attached to each heating layer. The first electrodes on each heating layer are respectively adapted for being electrically connected to different phases of a multiphase power source. The second electrodes on each heating layer are adapted for being electrically connected to a neutral of the power source or to each other. A third heating layer of electrically resistive sheet material can also be disposed on the substrate. The first electrode of the third heating layer is adapted for being electrically connected to a phase of the multiphase power source different from the phases to which the first electrodes of the first and second heating layers are adapted for being connected. The second electrode of the third heating layer being adapted for being electrically connected to the neutral of the power source or to the other second electrodes or to another phase of the multiphase power source.

The invention also provides an oven including an enclosure defining a generally parallelepipedic cooking cavity having five walls closed by a door. A heating panel is disposed on the walls and the door.

DESCRIPTION OF THE PREFERRED EMBODIMENTS

Figure 1:
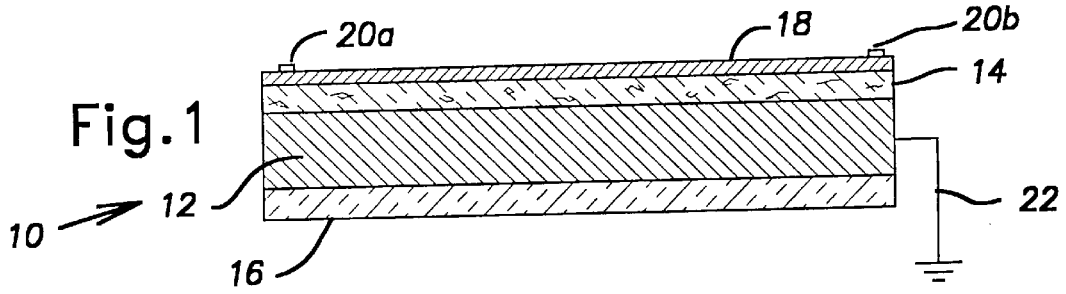
FIG. 1 shows a schematic end view of a heating panel for a two phase system according to the invention.
Figure 7:
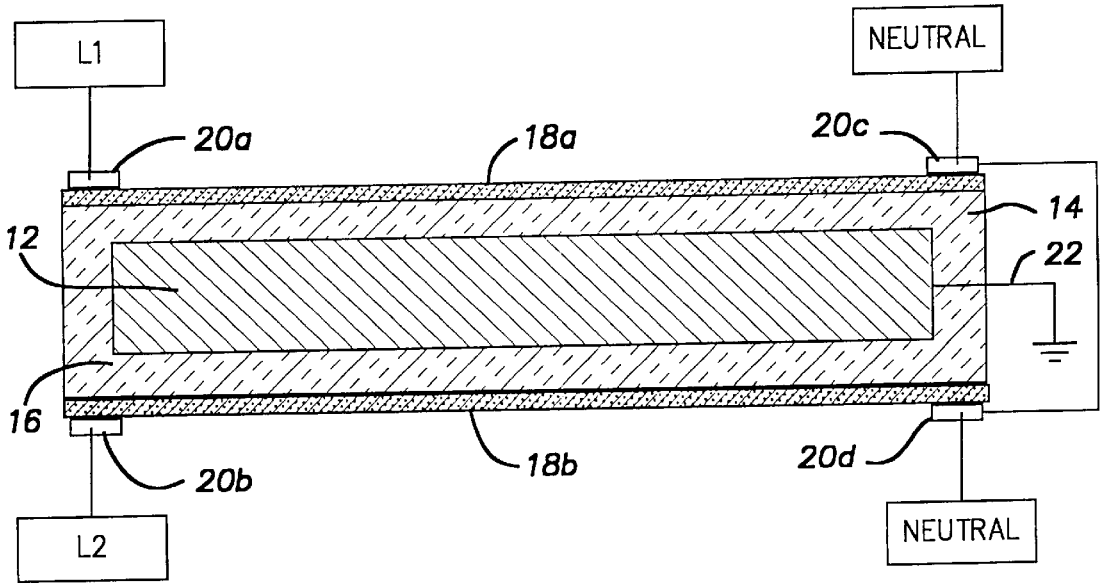
FIG. 7 shows an end view of a heating panel for a two phase system according to another embodiment of the invention.

Referring to FIG. 1, a heating panel 10 includes a substrate 12 made of a thermally and electrically conductive, durable material, such as steel. The substrate is preferably formed as a rectangular sheet generally defining dimensions of the panel 10. "Panel" refers generally to flat sheets or other shapes, such as cylinders or bent sheets. An outer insulating layer 14 of electrically insulating material, such as a ceramic, is applied to at least one face or surface of the substrate 12 so that an interior surface of the outer insulating layer 14 is in thermal communication with the substrate 12. Other suitable insulating materials include porcelain enamel, aluminum oxide, mica and organic polymers. An inner insulating layer 16 of electrically insulating material is applied to an opposite face of the substrate 12. A heating layer 18 of electrically resistive material, such as graphite, tin dioxide, or resistive thick film, is applied to or deposited on a face or exterior surface of the outer layer 14 opposite the substrate 12. The term "resistive material" will encompass any semiconductive or resistive material having a measurable resistance adapted for conversion of electrical energy into substantial heat energy when a current is passed therethrough, as is apparent from the following description. The outer insulating layer 14 can also include a thin (<1 $\mu$m) film of titanium dioxide or any other suitable oxide or nitride between the ceramic and the heating layer 18 to maintain electrical resistance at high temperatures. Other layers can be added to provide desired thermal, mechanical, chemical, or electrical characteristics. Also, in any of the embodiments, the inner and outer layers 14, 16 can be joined at edges of the substrate to substantially enclose the substrate, as shown in FIG. 7.

The heating panel 10 further includes a plurality of electrically conductive members, such as electrodes 20, attached to the heating layer 18 in electrical communication therewith. The electrodes 20 can be attached directly to the heating layer or mounted on the outer layer 14 with the heating layer deposited thereover. The electrodes 20 are positioned such that the heating layer 18 defines a sheet or film of material extending between the conductors. The electrodes 20 are electrically conductive, elongated bars or braids made of conductive thick film, for example, and provided with connectors, wires, or other means for connecting the electrodes to a source of electrical energy. Preferably, the electrodes are all made of the same material, have the same cross-sectional shape and dimensions, and are the same length.

Figure 1A:
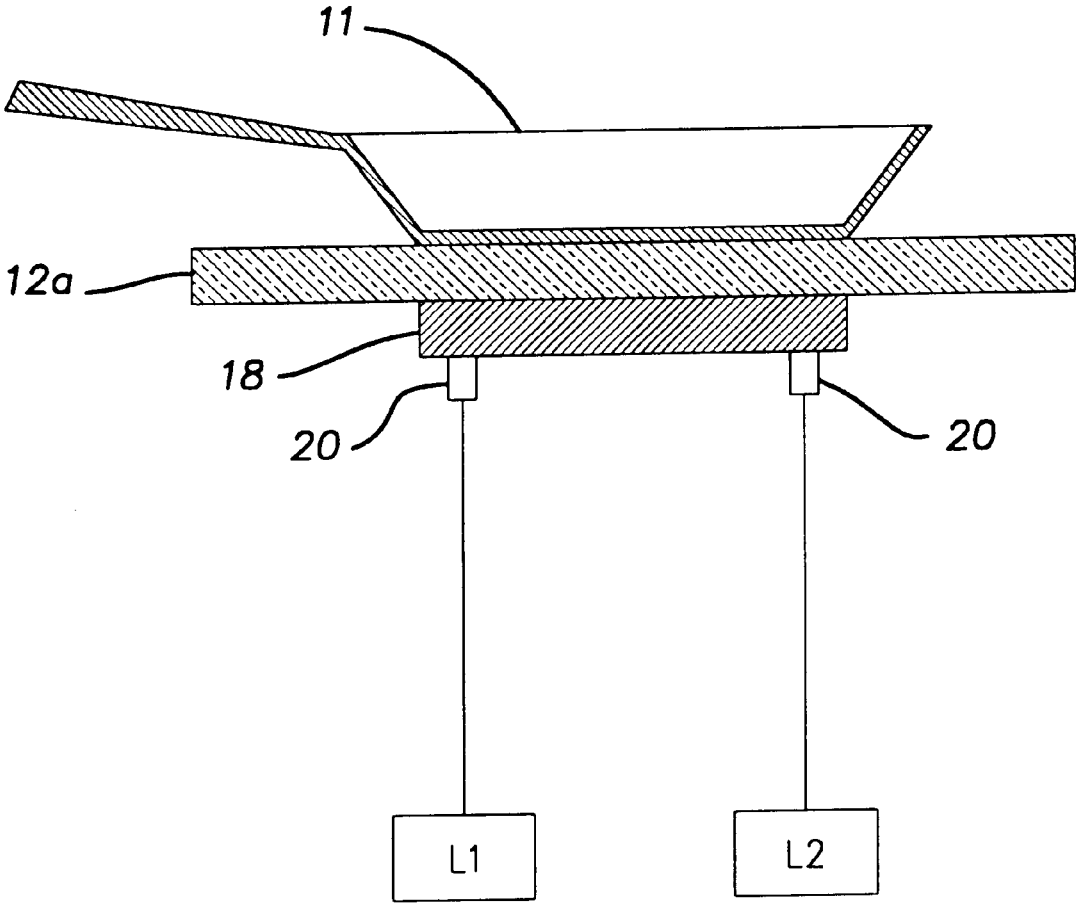
FIG. 1A shows an alternative construction of a heating panel.

FIG. 1A shows an alternative construction of the heating panel. The substrate 12*a* is made of an electrically insulating material, such as glass ceramic. The heating layer 18 is applied directly on the substrate 12*a*. The glass ceramic supports an object to be heated such as a pan 11. In a cook top configuration, shown in FIG. 1A, the substrate is sufficiently thermally conductive to conduct heat from the heating layer 18 to the pan 11, but does not conduct heat laterally beyond the outer dimensions of the heating layer, thereby providing a cool area around the pan. Because glass ceramic can become electrically conductive at high temperatures (>350° C.), it is desirable to provide at least one of the insulating layers 14, 16 in some cases. The electrical connections for this construction are similar to those provided for the construction of FIG. 1 as described below.

Figure 2:
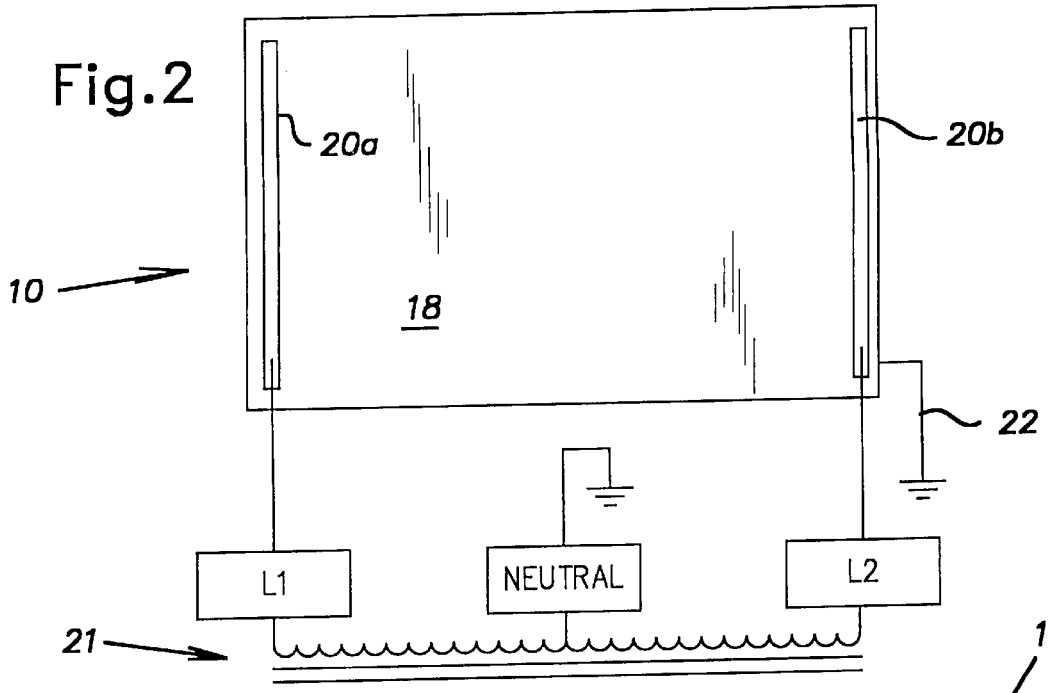
FIG. 2 shows a face of the heating panel of FIG. 1 or FIG. 1A.

Referring to FIGS. 1 and 2, a first electrode 20*a* is attached along one edge of the panel 10 and a second electrode 20*b* is attached along a second, generally parallel, edge of the panel. When installed, the first and second electrodes 20*a*, 20*b* are connected to different phases L1, L2 of a two phase power source, such as a synthetic 240 V household power source (sometimes known as the Edison system). Such a power source is a three wire AC system providing 240 volts across two wires on the secondary of a distribution transformer 21. The third wire is a neutral tapped from the center of the secondary that can also be used as a ground. The ground can alternatively be a dedicated ground. Where only single phase and three phase supplies are available (for example, in Europe), this type of two phase system can be synthesized from the single phase system by providing the transformer 21 in the apparatus using the heating panels. A third electrode, connected to the neutral, can also be provided on the panel.

As sometimes required by industry standards, the substrate 12 can be connected directly to ground by a suitable grounding conductor 22 or indirectly through the neutral of the power source. The term "ground" refers generally to any such direct or indirect connections to the neutral or a dedicated ground.

Current flowing through the heating layer 18 from the power source generates heat, which is conducted through the insulating layers 14, 16 and the substrate 12 to a space or object to be heated. Capacitive currents generated in the substrate 12 by the currents passing through the heating layer 18 cancel each other because the electrodes 20*a*, 20*b* supply current 180° out of phase. Thus, little or no leakage current travels through the ground conductor 22 from the capacitor formed by the heating panel 10. In the construction of FIG. 1A, capacitive currents in conductive objects on or near the substrate are similarly cancelled.

Figure 3:
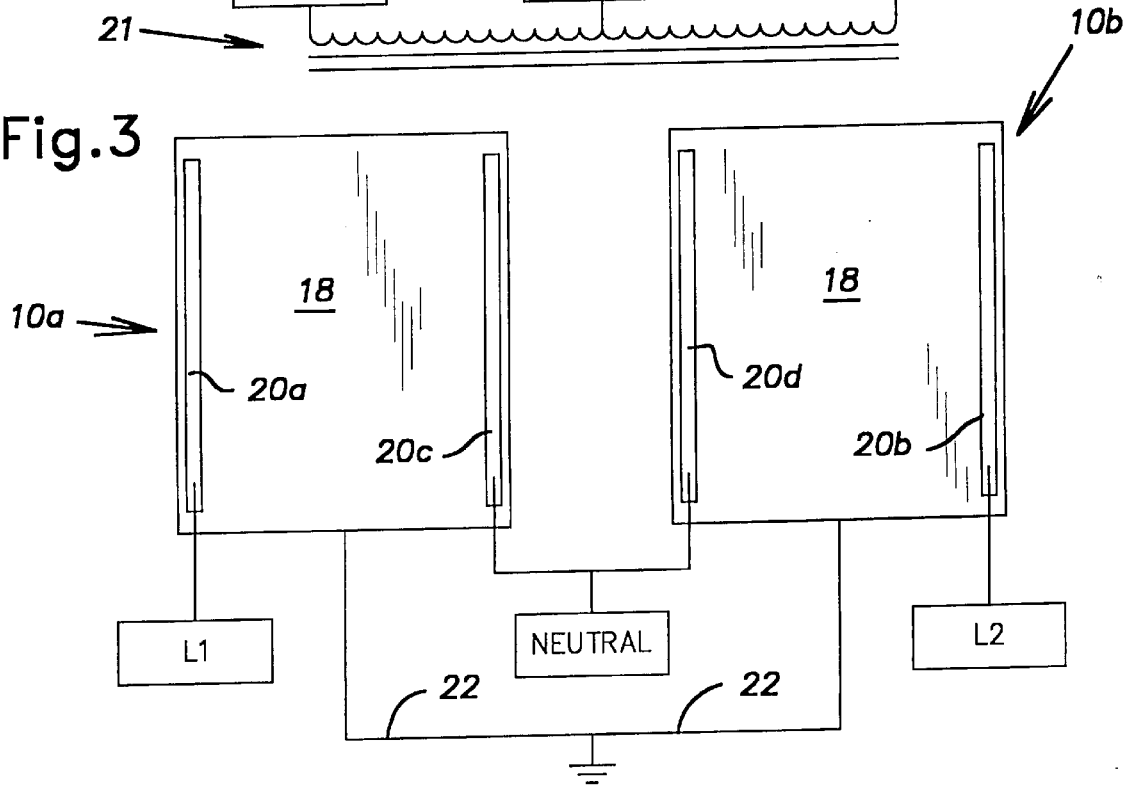
FIG. 3 shows a two heating panel assembly for a two phase system.

Referring to FIG. 3, two heating panels 10*a*, 10*b* are shown. When an even number of heating panels are connected to a two phase power source in the same system or assembly, only two electrodes 20 are required on each panel. The panels 10 are connected in pairs such that the first electrode 20*a* (on the first panel 10*a*) is connected to the first phase L1 and the second electrode 20*b* (on the second panel 10*b*) is connected to the second phase L2. A third electrode 20*c* (on the first panel 10*a*) and a fourth electrode 20*d* (on the second panel 10*b*) are connected to the neutral or connected to each other with or without connection to the neutral. The third and fourth electrodes 20*c*, 20*d*, connected to the neutral or to each other, are disposed along an edge of the respective panel 10 parallel with and opposite to the corresponding first and second electrodes 20*a*, 20*b*. Substrates of both panels 10*a*, 10*b* are connected to ground through the ground conductor 22.

Figure 4:
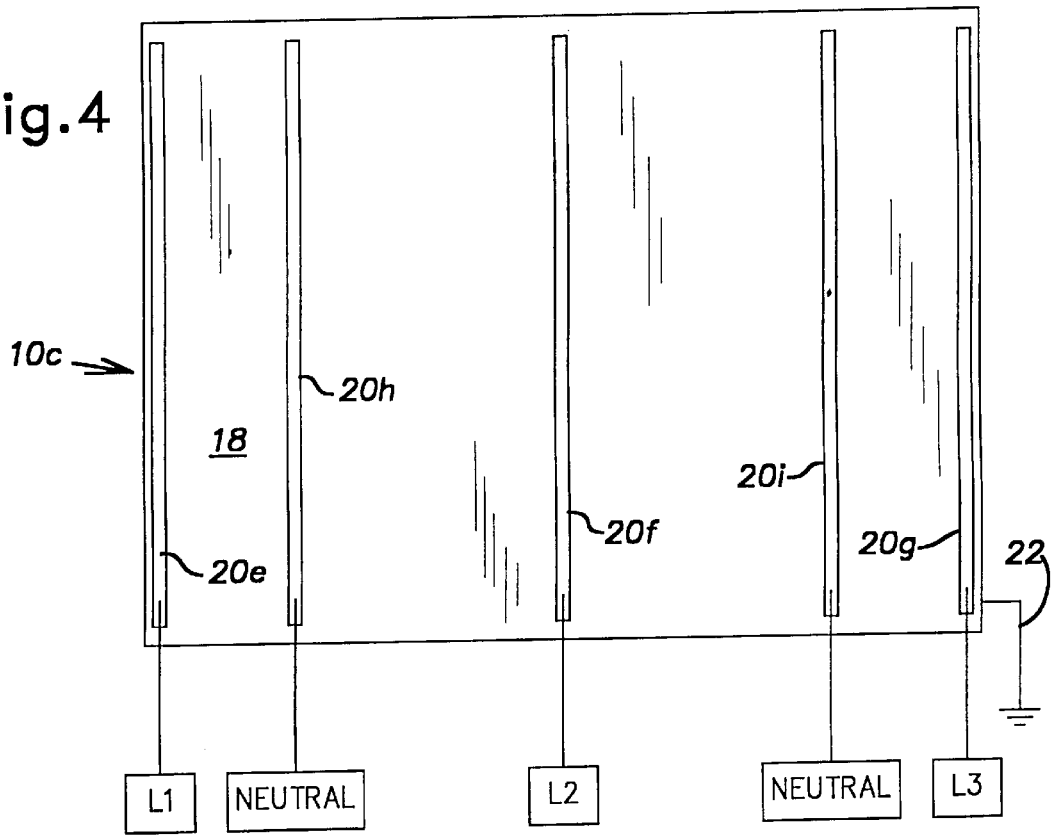
FIG. 4 shows a face of a heating panel for a three phase system.
Figure 5:
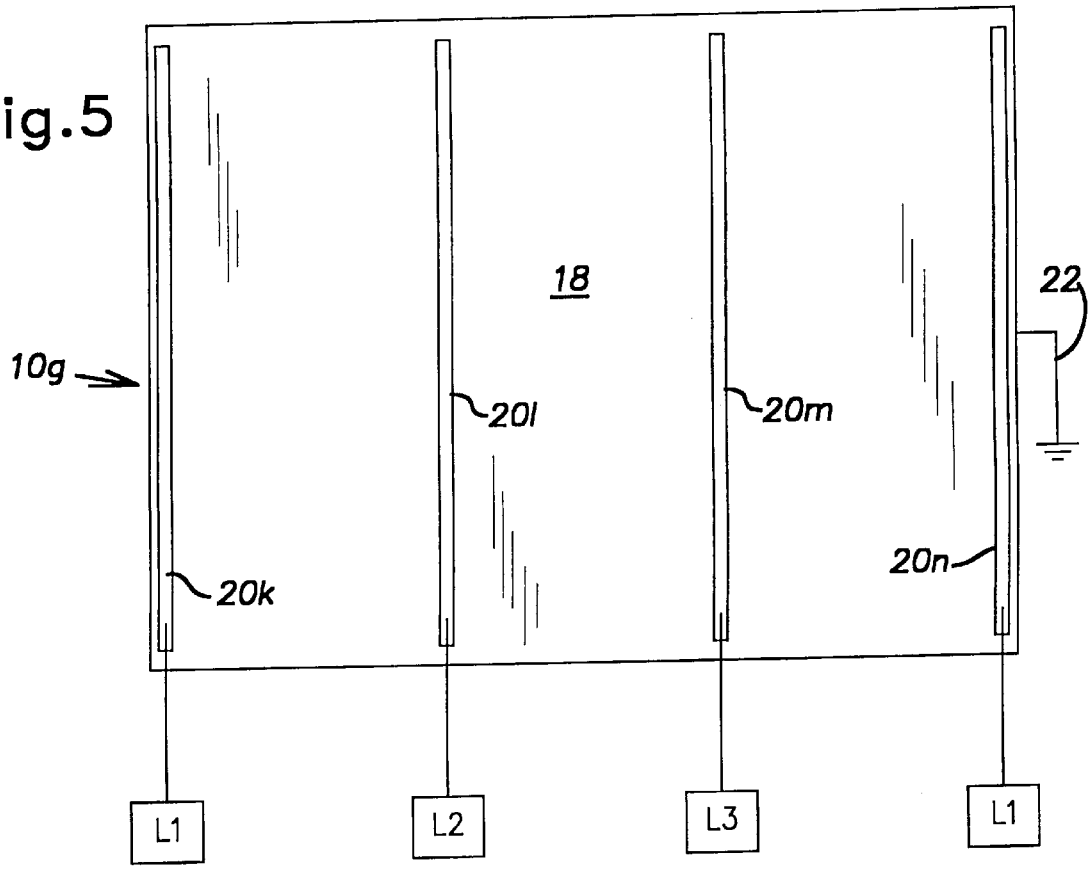
FIG. 5 shows a face of a heating panel for a three phase system without a neutral connection.

Referring to FIG. 4, the principles of the present invention also apply where the heating panel 10*c* is connected to a three phase power source. Three electrodes 20*e*, 20*f*, 20*g* are connected to respective phases L1, L2, L3 of the power source. Two of the electrodes 20*e*, 20*g* are disposed along opposite edges of the panel 10*c*, and one of the electrodes 20*f* is disposed near the middle of the panel. Preferably, the electrodes 20*e*, 20*f*, 20*g* are precisely evenly spaced. Two additional electrodes 20*h*, 20*i* are connected to the neutral of the power source and are spaced between pairs of the electrodes 20*e*, 20*f*, 20*g*. The electrodes 20*h*, 20*i* connected to the neutral are located closer to the electrodes 20*e*, 20*g* at the edges. Thus, the distance between the electrodes 20*e* and 20*f* is divided into thirds by the electrode 20*h*, which is one-third of the distance from electrode 20*e* and two-thirds of the distance from electrode 20*f*. The other electrodes 20*f*, 20*i* and 20*g* are similarly spaced. Theoretically the electrodes should be precisely spaced, as described, but in practice some adjustment may be required depending on the characteristics of the panel. Referring to FIG. 5, where a neutral connection is not desired or is not available (as in a Wye connected secondary) in a three phase source, four electrodes 20*k*, 20*l*, 20*m*, 20*n* are preferably provided. Two electrodes 20*k*, 20*n* disposed along opposite edges of the heating layer 18 of the panel 10*g* are connected to one phase L1 of the source. The other two electrodes 20*l*, 20*n* are precisely evenly spaced therebetween and connected to the remaining two phases L2, L3, respectively. The phases L1, L2, L3 of the power source are displaced 120° with respect to each other. Thus, capacitive leakage currents caused by the respective phases cancel each other to minimize leakage current through the ground conductor 22.

Figure 6:
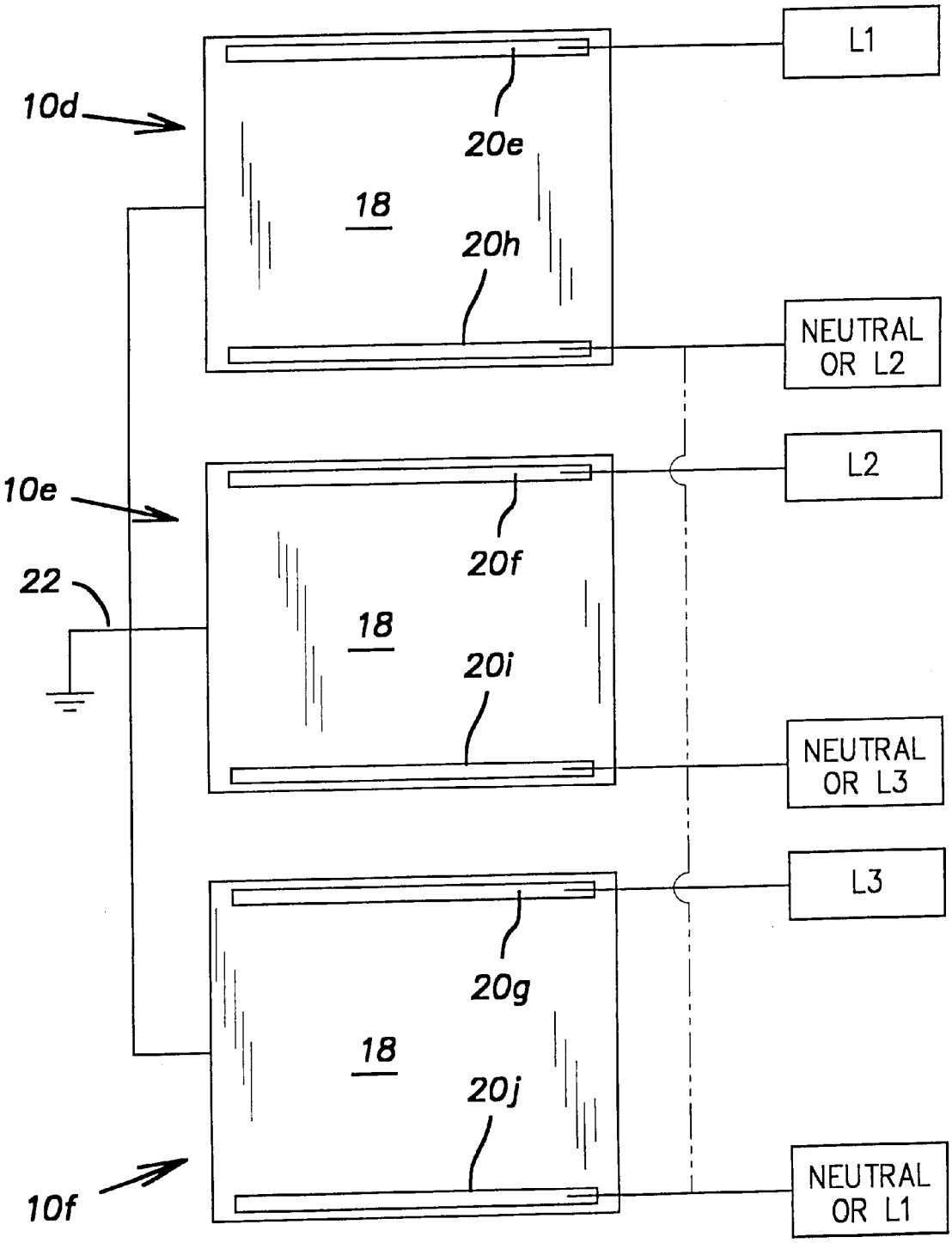
FIG. 6 shows a three heating panel assembly for a three phase system.

Referring to FIG. 6, three heating panels 10*d*, 10*e*, 10*f* are shown. When multiples of three heating panels are connected to a three phase power source in the same system or assembly, only two electrodes 20 are required on each panel. The panels 10 are connected in triads. The first electrode 20*e* (on the first panel 10*d* is connected to the first phase L1, the second electrode 20*f* (on the second panel 10*e*) is connected to the second phase L2, and the third electrode 20*g* (on the third panel 10*f*) is connected to the third phase L3. Fourth, fifth, and sixth electrodes 20*h*, 20*i*, 20*j*, on respective panels 10*d*, 10*e*, 10*f* can be connected to the neutral or connected to each other with or without connecting to the neutral. The electrodes 20*h*, 20*i*, 20*j* connected to the neutral or to each other are disposed along an edge of the respective panel 10*d*, 10*e*, 10*f* parallel with and opposite to the corresponding electrodes 20*e*, 20*f*, 20*g* connected to the three phases L1, L2, L3 of the power source. Substrates of all panels are grounded through the ground conductor 22. The panels of FIGS. 3 and 6 can be formed on a single substrate. In addition, the electrodes connected together (20*c*, 20*d* and 20*h*, 20*i*, 20*j* can be aligned and formed as a single electrode bridging the gaps between the heating layers.

Figure 8:
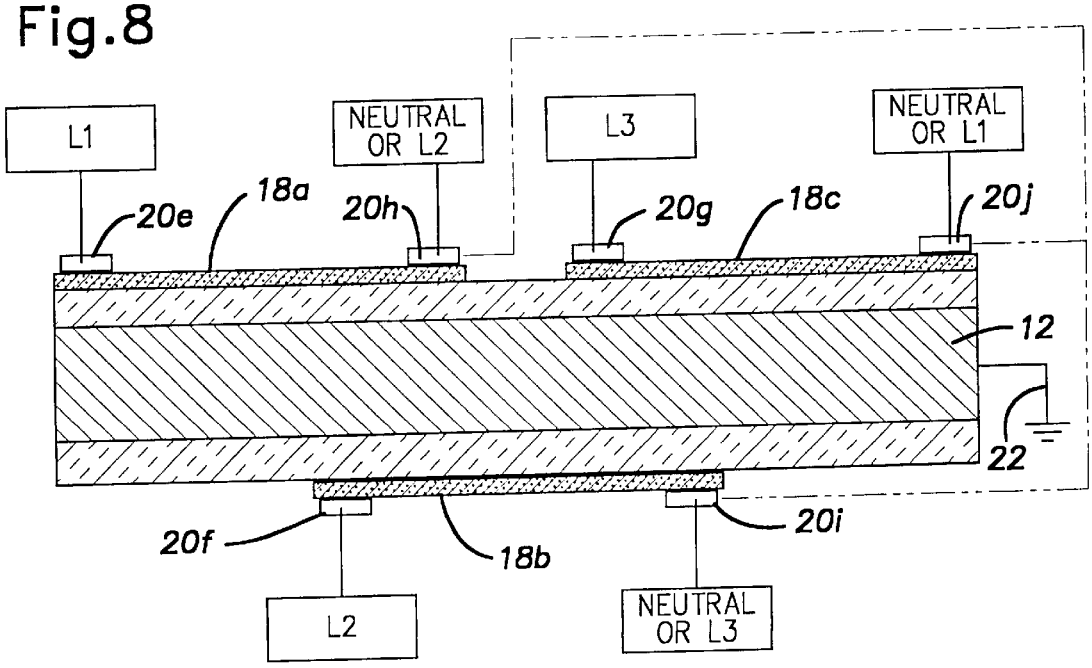
FIG. 8 shows an end view of a heating panel for a three phase system according to another embodiment of the invention.

As shown in FIGS. 7 and 8, plural heating layers can be mounted on different faces of a single substrate. Referring to FIG. 7, the outer insulating layer 14 and inner insulating layer 16 are disposed on the substrate 12. A first heating layer 18*a* is disposed on the outer insulating layer 14. Two electrodes 20*a*, 20*c* are electrically connected with the heating layer and disposed along opposed edges thereof. One electrode 20*a* is connected to one phase L1 of a two phase power source and the other electrode 20*c* is connected to the neutral. A second heating layer 18*b*, substantially identical with the first, is disposed on the inner insulating layer 16. Two electrodes 20*b*, 20*d* are connected to the second heating layer 18*b* opposite to the electrodes 20*a*, 20*c* on the first heating layer. One electrode 20*b* is connected to the other phase L2 of the two phase power source and the other electrode 20*d* is connected to the neutral. Alternatively, the electrodes 20*c*, 20*d* can be connected to each other and the neutral connections can be omitted. The substrate is connected to ground through the ground conductor 22. This construction is similar to FIG. 3, except that the heating layers are disposed on opposite faces of the same substrate.

Referring to FIG. 8, three heating layers 18*a*, 18*b*, 18*c* are disposed on two faces of a single substrate 12. In this case, the heating layers are substantially smaller than the substrate 12. As shown, two of the heating layers 18*a*, 18*c* are disposed on one face of the substrate and the other heating layer 18*b* is disposed on the opposite face. Alternatively, all of the heating layers 18 can be disposed on one face of the substrate as described previously with reference to FIG. 6. Each heating layer has a first electrode 20*e*, 20*f*, 20*g* connected to a different phase L1, L2, L3 of a three phase power source. A second electrode 20*h*, 20*i*, 20*j* on each heating layer is connected to the neutral of the three phase power source. Alternatively, the second electrodes 20*h*, 20*i*, 20*j* can be connected together and the neutral omitted. In another alternative, electrode 20*h* is connected to phase L2, electrode 20*i* is connected to phase L3 electrode 20*j* is connected to phase L1, and the neutral is omitted. The electrical connections in FIG. 8 are similar to those shown in FIG. 6, thus, in FIG. 6, the electrodes 20*h*, 20*i*, 20*j* can be connected to the phases L2, L3, L1, respectively and the neutral can be omitted. The substrate is connected to ground through the ground conductor 22. This construction is similar to FIG. 6, except that the heating layers are disposed on opposite faces of the same substrate. Additional layers can be applied over the heating layers 18 for electrical insulation and protection.

Figure 9:
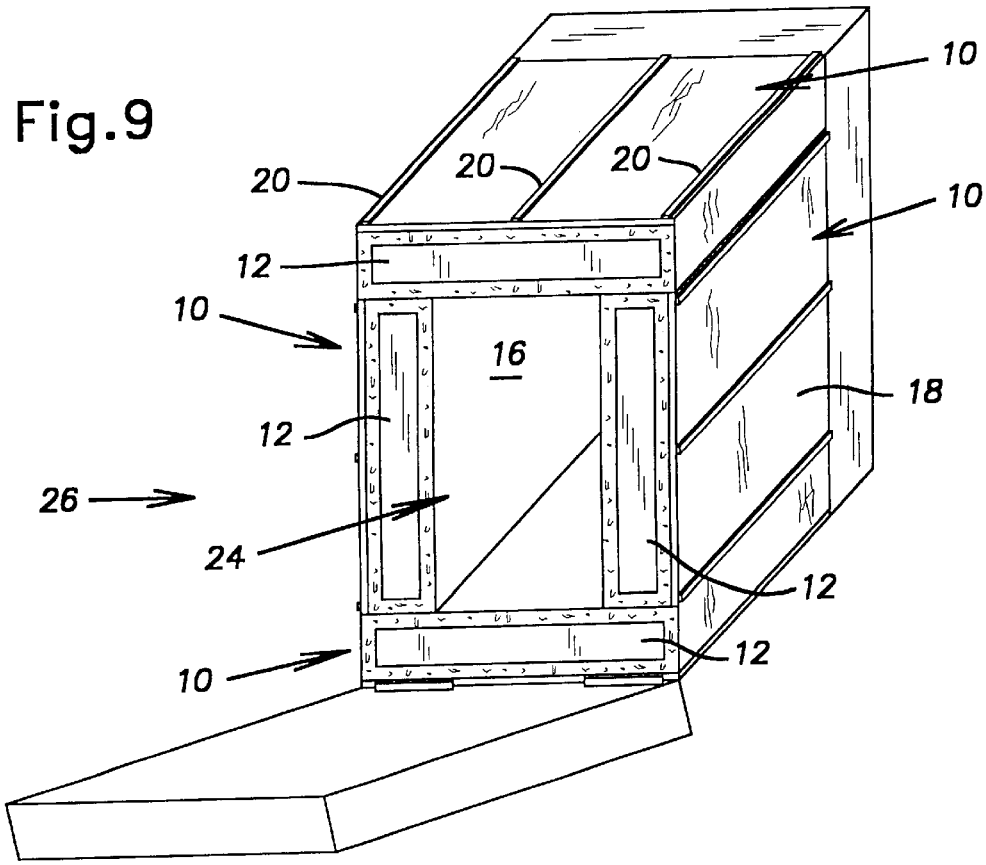
FIG. 9 shows heating panels arranged to form an oven.

Referring to FIG. 9, six heating panels 10 are arranged to form a heating cavity 24 of an oven 26, such as a domestic range used for cooking food. Four heating panels define sides of the generally parallelepipedic heating cavity, one heating panel defines the back wall, and one is pivotably mounted to define a door of the oven 26. The inner insulating layers 16 of the heating panels face inwardly toward the heating cavity 24. FIG. 9 is not to scale and the heating panels 10 are substantially thinner than they appear. The heating panels 10 can be mounted on an existing oven structure or integrally manufactured with the oven structure. The panels 10 can be separately connected to a multiphase power source. However, since the number of panels is divisible by two and three, the panels can be connected in a two phase or three phase system, as described above with reference to FIGS. 3 and 6. The panels can also be constructed as shown in FIG. 1A. Also, the substrates can be formed of a single piece having separate heating layers applied thereon.

In all of the disclosed embodiments, geometrical and electrical symmetry is preferred. For example, the heating layers 18 should have the same thickness and surface area, as well as the same resistance, between the electrodes to create substantially equal and opposite capacitive currents. Capacitive leakage current is a function of the thickness of the layer between the resistive sheet and the substrate. Therefore, the thicknesses of the insulating layers should be uniform.

The present disclosure describes several embodiments of the invention, however, the invention is not limited to these embodiments. Other variations are contemplated to be within the spirit and scope of the invention and appended claims.

What is claimed is:

1. A heating panel comprising:

a substrate;

a heating layer of electrically resistive sheet material disposed on a face of the substrate; and first and second electrodes attached to the heating layer and electrically connected to different phases of a multiphase power source, the first and second electrodes being elongated bars made of conductive film.

2. A panel according to claim 1 wherein the substrate is a sheet of glass ceramic.

3. A panel according to claim 1 wherein the substrate is electrically conductive and connected to ground and further comprising an insulating layer disposed between the substrate and the heating layer.

4. A heating panel according to claim 1 wherein the power source has two phases and the first and second electrodes are connected 180° out of phase.

5. A heating panel according to claim 4 wherein the power source includes a transformer from which the two phases are tapped and a center tapped neutral between the two phases, the neutral being connected to ground.

6. A heating panel according to claim 1 wherein the heating layer is adapted for converting electrical current therethrough to heat energy transferred therefrom.

7. A heating panel according to claim 1 wherein the first and second electrodes are disposed along opposite edges of the heating layer.

8. A heating panel comprising:

a substrate;

a heating laver of electrically resistive sheet material disposed on a face of the substrate;

first and second electrodes attached to the heating layer and electrically connected to different phases of a multiphase power source, the first and second electrodes being elongated bars made of conductive film: and a third electrode electrically connected to the heating layer and connected to the third phase of the power source.

9. A heating panel according to claim 8 wherein the power source has three phases and the first, second, and third electrodes are connected 120° out of phase from each other.

10. A heating panel according to claim 8 wherein the first and third electrodes are disposed along opposite edges of the heating layer and the second electrode is disposed about midway between the first and third electrodes.

11. A heating panel comprising:

a substrate;

a heating layer of electrically resistive sheet material disposed on a face of the substrate;

first and second electrodes attached to the heating layer and electrically connected to different phases of a multiphase power source, the first and second electrodes being elongated bars made of conductive film; and the substrate is porcelain enameled steel.

12. A heating panel according to claim 1, wherein the heating layer is a substantially continuous sheet.

13. A heating panel assembly comprising:

first and second heating panels, each panel comprising a substrate; a heating layer of electrically resistive sheet material disposed on the substrate; and first and second electrodes attached to the heating layer;

the first electrodes being respectively connected to different phases of a multiphase power source; and the second electrodes being electrically connected to each other.

14. A heating panel assembly according to claim 13 further comprising an insulating layer disposed between the substrate and the heating layer, wherein the substrate is electrically conductive and connected to ground.

15. A heating panel assembly comprising:

first and second heating panels, each panel comprising a substrate; a heating layer of electrically resistive sheet material disposed on the substrate; and first and second electrodes attached to the heating layer;

the first electrodes being respectively connected to different phases of a multiphase power source; and the second electrodes being electrically connected to each other; and a third heating panel comprising a substrate; a heating layer of electrically resistive sheet material disposed on the substrate; a first and second electrodes attached to the heating layer;

the first electrode of the third panel being electrically connected to a phase of the multiphase power source different from the phases to which the first electrodes of the first and second panels are connected; and the second electrode of the third panel being electrically connected to the second electrodes of the first and second panels.

16. A heating panel assembly according to claim 15 wherein the power source has three phases and the first electrodes of the first, second, and third panels are connected 120° out of phase from each other.

17. A heating panel assembly according to claim 15 wherein the substrates of the panels are formed as a unitary member.

18. A heating panel according to claim 17, wherein the unitary member has a first and a second surface, the heating layer of the first heating panel is disposed on the first surface and the heating layer of one of the second or third heating panels is disposed on the second surface.

19. A heating panel according to claim 15, wherein the heating panels are separate from each other.

20. A heating panel according to claim 15, wherein the second electrodes are electrically connected to ground.

21. A heating panel according to claim 17, wherein the substrates are porcelain enameled steel.

22. A heating panel according to claim 13, wherein the heating panel s are separate from each other.

23. A heating panel according to claim 13, wherein the second electrodes are electrically connected to a neutral of the power source.

24. A heating panel according to claim 13, wherein the first and second heating panels comprise separate substrates.

25. A heating panel assembly comprising:

first, second, and third heating panels, each panel comprising a substrate; a heating layer of electrically resistive sheet material disposed on the substrate; and first and second electrodes attached to the heating layer;

the first electrodes being respectively adapted for being electrically connected to different phases of a multiphase power source; and the second electrodes being electrically connected to the phases of the power source such that two different phases are connected to the respective electrodes of each one of the panels.

26. A heating panel assembly according to claim 17 wherein the power source has three phases and the first, second, and third electrodes are connected 120° out of phase from each other.

27. A heating panel assembly according to claim 17 wherein the substrates of the panels are formed as a unitary member.

28. A heating panel according to claim 25, wherein the substrates are porcelain enameled steel.

29. An oven comprising:

an enclosure defining a generally parallelepipedic cooking cavity having five walls closed by a door;

a heating panel disposed on one of the walls, the heating panel comprising:

a substrate;

a heating layer of electrically resistive sheet material disposed on the substrate;

a first electrode attached along an edge of the heating layer and adapted for being electrically connected to one phase of a multiphase power source; and a second electrode attached along an edge of the heating layer opposite from the first electrode and adapted for being electrically connected to a second phase of the multiphase power source, wherein the first and second electrodes are elongated bars made of conductive film.

30. An oven according to claim 26 further comprising an insulating layer disposed between the substrate and the heating layer, wherein the substrate is electrically conductive and connected to ground.

31. An oven according to claim 26, wherein the power source has two phases and the first and second electrodes are connected 180° out of phase.

32. An oven according to claim 26 wherein the substrate is glass ceramic.

33. A heating panel according to claim 29, wherein the substrate is porcelain enameled steel.

34. An oven having an oven cavity heated by conversion of electrical energy into heat energy comprising:

an insulating layer fabricated of an electrically insulative material and with a geometric shape enclosing said oven cavity to be heated, said insulating layer having a first surface forming an exterior surface of said cavity and a second surface forming an interior surface of said cavity and from which heat energy enters said cavity after conduction through said insulating layer;

a substrate fabricated of an electrically conductive material electrically connected to ground and secured to said insulating layer first surface and from which heat energy enters said cavity after conduction through said substrate;

a plurality of spaced-apart electrically conductive members positioned adjacent to said insulating layer first surface;

a sheet of material directly secured between, and in electrical contact with, said plurality of conductive members and secured to at least a portion of said insulating layer first surface;

at least one additional plurality of spaced-apart electrically conductive members positioned adjacent to said insulating layer first surface at a location remote from said plurality of conductive members;

at least one additional sheet of material, secured to other portions of said insulating layer first surface different from the portion of said insulating layer first surface to which said sheet of material is secured, each of said at least one additional sheet directly secured and electrically connected between at least an associated pair of the at least one additional plurality of conductive members;

the material of said sheet and said at least one additional sheet having a predetermined electrical resistance measurable between different ones of said conductive and additional conductive members;

the resistance of said material of said sheet and of said at least one additional sheet of material causing conversion of electrical energy, coupled into said sheet and said at least one additional sheet via associated ones of the total number of said conductive members, into heat energy for energy transfer through said insulating layer and from said insulating layer second surface into said cavity; and means for connecting a source of multiphase electrical energy to predetermined ones of the total number of conductive members to cause electrical energy to be converted to heat energy in associated predetermined ones of the sheet and the at least one additional sheet fabricated upon said insulating layer first surface, wherein two of said conductive members are adapted for being connected to different phases of the multiphase source.

35. An oven according to claim 31 wherein the conductive members are arranged so as to cause opposed capacitive currents.

36. An oven according to claim 35 wherein the multiphase source has two phases and the different phases are 180° out of phase.

37. An oven according to claim 35 wherein the multiphase source has three phases and the different phases are 120° out of phase.

38. A heating panel comprising:

an electrically conductive rigid substrate connected to ground;

a heating layer of electrically resistive sheet material disposed on a face of the substrate;

an insulating layer disposed between the substrate and the heating layer; and first and second electrodes attached to the heating layer and electrically connected to different phases of a multiphase power source, wherein the power source includes a transformer from which the phases are tapped and a center tapped neutral is connected to ground.

39. A heating panel according to claim 38, wherein the substrate is steel and the insulating layer is porcelain enamel.

40. A heating panel comprising:

a substrate;

a heating layer of electrically resistive sheet material disposed on a face of the substrate;

first, second and third electrodes electrically connected to the heating layer and electrically connected to different phases of a multiphase power source; and a fourth electrode electrically connected to the heating layer and electrically connected to the same phase of the power source to which the first electrode is connected.

41. A heating panel according to claim 37 wherein the power source has three phases and the first, second, and third electrodes are connected 120° out of phase from each other.

42. A heating panel according to claim 37, wherein the first and fourth electrodes are disposed along opposite edges of the heating layer and the second and third electrodes are evenly spaced between the first and fourth electrodes.

* * * * *

UNITED STATES PATENT AND TRADEMARK OFFICE

CERTIFICATE OF CORRECTION

PATENT NO. : 5,940,579

DATED : August 17, 1999

INVENTOR(S) : Kallgren et al.

It is certified that error appears in the above-indentified patent and that said Letters Patent is hereby corrected as shown below:

Column 2, Line 7, delete "12020" and insert --120°--.

Column 8, Line 34, Claim 21, delete "claim 17" and insert --claim 13--.

Column 8, Line 56, Claim 26, delete "claim 17" and insert --claim 25--.

Column 8, Line 60, Claim 27, delete "claim 17" and insert --claim 26--.

Column 9, Line 14, Claim 30, delete "claim 26" and insert --claim 29--.

Column 9, Line 18, Claim 31, delete "claim 26" and insert --claim 29--.

Column 9, Line 21, Claim 32, delete "claim 26" and insert --claim 29--.

UNITED STATES PATENT AND TRADEMARK OFFICE

CERTIFICATE OF CORRECTION

PATENT NO. : 5,940,579

DATED : August 17, 1999

INVENTOR(S) : Kallgren et al.

It is certified that error appears in the above-indentified patent and that said Letters Patent is hereby corrected as shown below:

Column 10, Line 18, Claim 35, delete "claim 31" and insert --claim 34--.

Column 10, Line 55, Claim 41, delete "claim 37" and insert --claim 40--.

Column 10, Line 58, Claim 42, delete "claim 37" and insert --claim 40--.

Signed and Sealed this

Twenty-sixth Day of September, 2000

*Attest:*

Q. TODD DICKINSON

*Attesting Officer*

*Director of Patents and Trademarks*